United States Patent [19]

Meredith, Jr.

[11] Patent Number: 4,685,262

[45] Date of Patent: Aug. 11, 1987

[54] MAIN BEAM FOR CEILING PANEL SUSPENSION SYSTEM

[75] Inventor: Thomas C. Meredith, Jr., Columbia, S.C.

[73] Assignee: Consolidated Systems, Inc., Columbia, S.C.

[21] Appl. No.: 788,629

[22] Filed: Oct. 17, 1985

[51] Int. Cl.[4] ..... E04C 2/00

[52] U.S. Cl. ..... 52/232; 52/484; 52/726; 52/DIG. 5

[58] Field of Search ..... 52/232, 573, 726, 484, 52/DIG. 5

[56] References Cited

U.S. PATENT DOCUMENTS

| | | | |
|---|---|---|---|
| 3,189,139 | 6/1965 | Znamirowski et al. | 52/573 |
| 3,388,519 | 6/1968 | Downing, Jr. | 52/232 |
| 3,496,690 | 2/1970 | Jahn | 52/232 |
| 3,778,947 | 12/1973 | Sauer | 52/232 |
| 3,928,950 | 12/1975 | Beynon | 52/726 |
| 3,965,631 | 6/1976 | Sauer | 52/232 |
| 3,979,874 | 9/1976 | Cubbler, Jr. et al. | 52/484 X |
| 4,128,978 | 12/1978 | Beynon | 52/232 |
| 4,531,340 | 7/1985 | Sauer | 52/726 |
| 4,549,383 | 10/1985 | Vukmanic et al. | 52/726 X |

*Primary Examiner*—Carl D. Friedman

*Attorney, Agent, or Firm*—L. Lawton Rogers, III; Joseph M. Killeen

[57] ABSTRACT

A main beam for a ceiling grid suspension system with an improved connector and compression section. The connector is of the tongue and strap type, compact with improved resistance to bending. The compression section includes an interrupted and compressed bead, a creased web strap and a downward deflecting flange.

18 Claims, 9 Drawing Figures

MAIN BEAM FOR CEILING PANEL SUSPENSION SYSTEM

BACKGROUND OF THE INVENTION

This invention relates to a main beam for a ceiling panel suspension system and more paticularly to a main beam with an improved connector and thermal expansion absorbing section.

The main beams of ceiling panel suspension systems are configured for end-to-end connection. These main beams must be simple and economical to manufacture, quickly and easily connected, and must ensure longitudinal alignment. The connection must be secure against accidental uncoupling, but must also allow the beam to be uncoupled in case replacement of the beam becomes necessary.

One known means for connecting main beams in an end-to-end configuration is a tongue and strap configuration such as illustrated, for example, in the Beynon U.S. Pat. No. 3,928,950, dated Dec. 30, 1975. Such connections generally include a tongue protruding from the end of the web of the main beam, where the tongue is laterally displaced from the web and includes a detent laterally displaced from the tongue in the same direction to provide a rearward facing shoulder. Such connectors also laterally offset an area of the web immediately adjoining the tongue in the opposite direction of the tongue to form a vertical strap as well as an area of the web immediately rearward of the strap in the same direction as the tongue to form a groove, the tongue of the connecting beam being received in the groove behind the strap with the rearward facing shoulder of the detent engaging the rearward facing surface of the strap. The forward facing surfaces of the strap and the groove may be flared to guide the tongue of the connecting beam during insertion.

Other known tongue and strap connectors such as shown in the Cubbler, Jr., et al. U.S. Pat. No. 3,979,874, dated Sept. 14, 1976, further elongate the tongue and employ two straps and detents in the connection. The two detents of the tongue are displaced in the same direction as the tongue and engage the rearward facing surfaces of the strap. Such connectors generally displace the tongue and strap portions from the web the full width of the web.

Known tongue and strap connectors such as discussed above accomplish retention solely by the engagement of the detent with the rearward facing surface of the strap or the web. Use of the detent as the sole locking means requires close manufacturing tolerances and/or relatively heavy gauge material to avoid deflection or distortion of the connection. In addition, the tongue is necessarily elongated by engagement of the detent with the rear of the strap rather than the web at the front of the strap, particularly where two straps are required.

Still other tongue and strap connectors such as shown in the Jahn U.S. Pat. No. 3,496,690, dated Feb. 24, 1970, have attempted to shorten the length of the tongue and thus reduce the likelihood of damage thereto during shipment and during on-site handling by engaging the detent with the rearward facing shoulder of the web formed by lateral displacement of the strap. However, the lateral force holds the detent engaged by holding the tongue of one beam against the web of the other and resists further telescoping movement of the beam. This resistance may inhibit thermal expansion and result in buckling failure of the system in the event of fire.

While other, more positive connectors are known, they generally require multiple parts, increasing the difficulty in manufacture, and/or must be destroyed when disconnection is required.

Accordingly, it is the object of the present invention to obviate these and other problems of generally known connectors and to provide a novel main beam connector for a ceiling grid system.

Another object of the present invention is to provide a novel main beam which is easily and quickly connected to provide a positive and secure interlock, yet which allows disengagement without destruction of the connector.

Yet another object of the present invention is to provide a novel main beam connector having positive guide means to urge the beams into longitudinal alignment as they are mated.

A further object of the present invention is to provide a novel one piece connector integral with and formed from the beam to provide economy of manufacture.

In another aspect, fire rated ceiling panel suspension grid main beams commonly use a compressible section intermediate the ends thereof for confining the beam deformation due to thermal expansion of that section, thereby avoiding the twisting or buckling that would cause the grid to lose support for the ceiling panels. Such compressible sections include means for allowing each vertical portion of the beam—the web, flange and bead—to absorb longitudinal expansion without loss of alignment while maintaining support for the panels by the flange.

Generally, the means for allowing the flange to absorb longitudinal expansion consist of an interruption in the web which acts to concentrate the flange stress along three equally spaced lateral lines, so that the flange folds downwardly along the center line into a V-shape when subjected to compression. Such means are illustrated, e.g., in the Downing, Jr. U.S. Pat. No. 3,388,519, dated June 18, 1968; the Sauer U.S. Pat. No. 3,778,947, dated Dec. 18, 1973; and Sauer U.S. Pat. No. 3,965,631, dated June 29, 1976.

The structures for allowing the web and bead to absorb longitudinal expansion vary widely. One known structure (e.g., Sauer '631) for allowing the web and bead to absorb longitudinal expansion flattens the bead so that the opposing sidewalls are abutting, thus allowing the flattened bead portion and adjacent web to fold as a unit under compression.

Still other structures (e.g., Sauer '947), disclose a bead in which the top wall is interrupted, the sidewalls are flattened into abuttment and the web portion vertically aligned with the bead deformation includes a slot extending from the bead toward the flange.

Such bead and web compressible sections are designed to allow the bead and web to deform without dropping the ceiling panels. However, and as shown in the aforementioned patents, the bead of such sections often suffers substantial longitudinal misalignment as a result of compression, causing the beam to twist, and jeopardizing the support for the panels.

In addition, such sections generally require the removal of metal from the web and in some instances from the bead as well. This often presents manufacturing difficulties.

It is accordingly an object of this invention to obviate these and other problems to provide a novel fire rated main beam.

It is another object of this invention to provide a novel main beam capable of absorbing thermally induced longitudinal expansion without any substantial longitudinal misalignment.

A further of this invention is to provide a main beam in which the necessity of removing material from the web and/on bead in forming the compressible section is obviated.

A still further object of this invention is to provide a new and improved thermally compressible main beam for a ceiling panel suspension system in which the bead is notched and flattened and the web creased to control deformation in the presence of thermally induced longitudinal expansion.

These and many other objects and advantages of the present invention will be apparent to one skilled in this art from the claims and from the detailed description of the preferred embodiments when read in conjunction with the appended drawings.

DETAILED DESCRIPTION OF A PREFERRED EMBODIMENT

Figure 1:
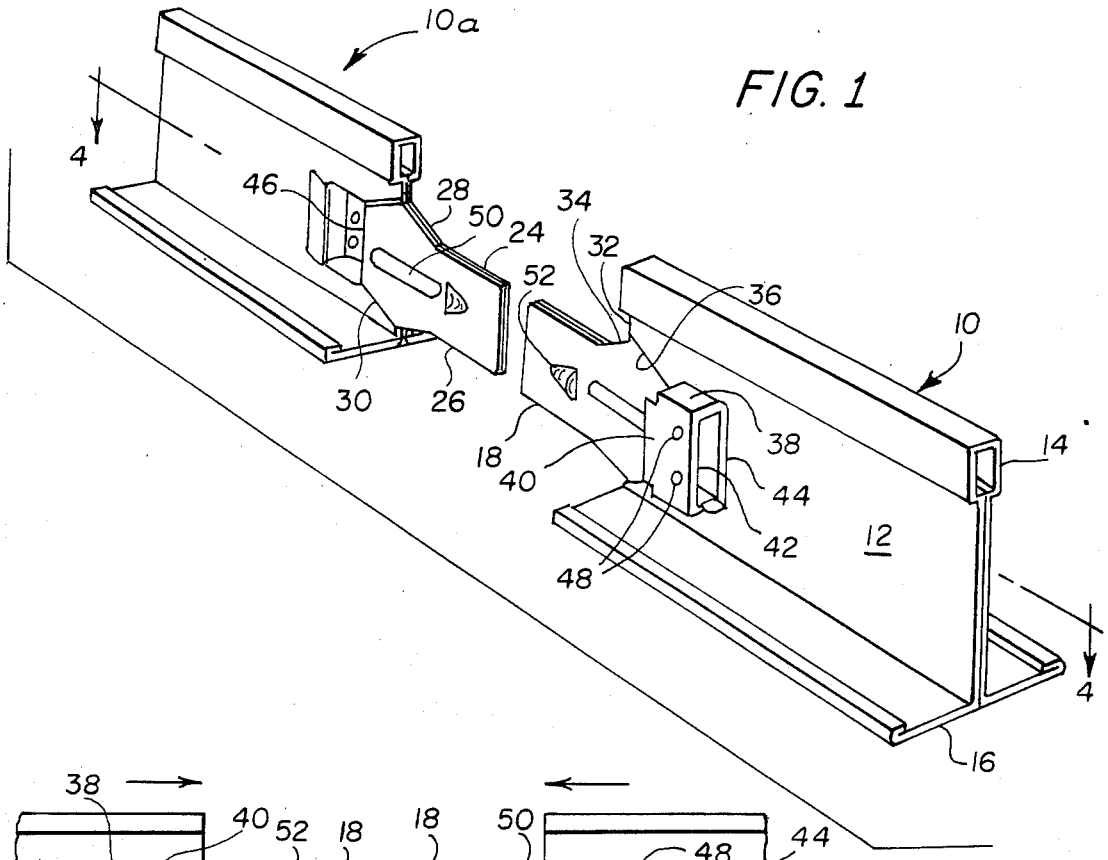
FIG. 1 is a pictorial view of one embodiment of the main beam in accordance with the present invention showing the end connections.
Figure 2:
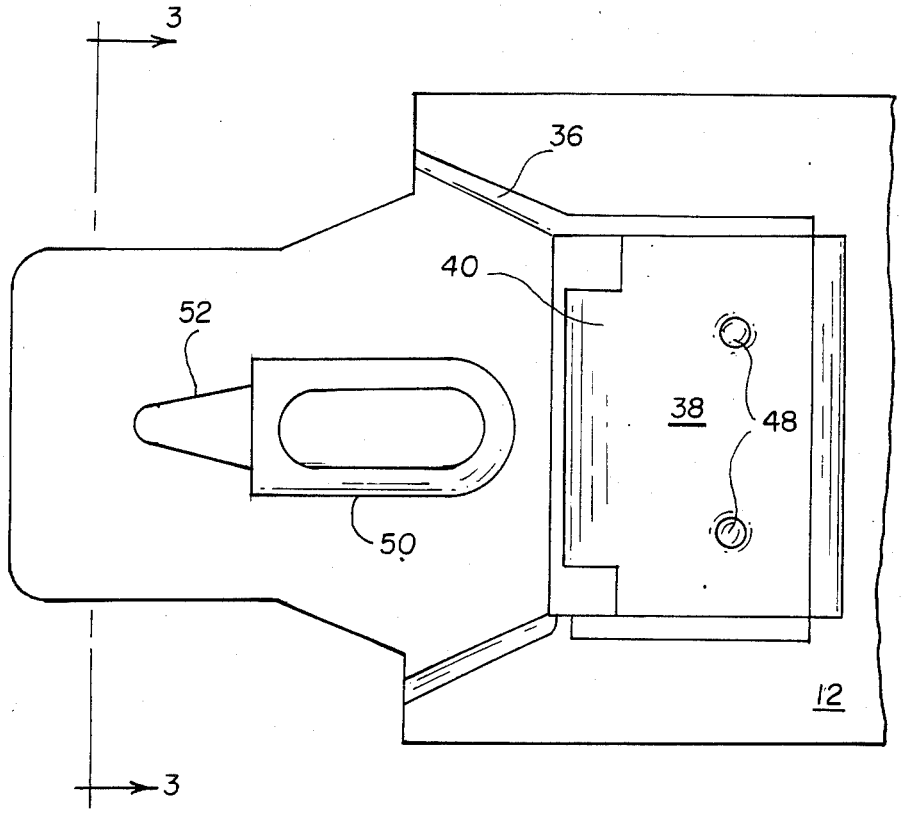
FIG. 2 is an elevational view of the connector of the main beam of FIG. 1.
Figure 3:
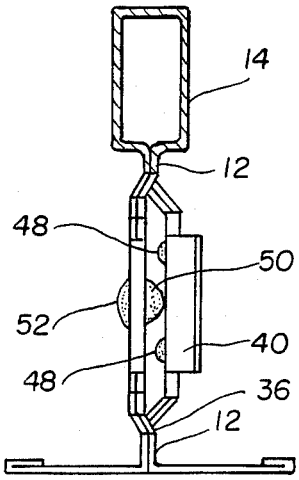
FIG. 3 is a vertical section taken through lines 3—3 of FIG. 2.

As shown in FIGS. 1–3, two beams 10 and 10*a* have a vertical planar web 12 with a rigidity enhancing bead 14 provided along the upper marginal edge thereof and a ceiling panel supporting flange 16 extending outwardly from the lower marginal edge thereof.

A tongue 18, integral with the web 12, extends from the end of the web. The forward end of the tongue 18 has substantially parallel top 24 and bottom 26 edges, and the top 28 and bottom 30 edges of the rearward end of the tongue are inclined in a manner to vertically broaden the tongue 18 toward the beam to increase the resistance to bending, both in use and in shipment.

From a point 32 adjacent to but vertically spaced from the junction of the tongue and web, the web is also laterally displaced in the same direction as the tongue to provide a groove, having inclined shoulder 36 sloping rearward toward a strap 38. The vertical strap 38 is laterally displaced from the web 12 in the opposite direction from the coplanar tongue and groove. The deformation of the strap 38 out of the flange of the web 12 forms rearward and forward facing strap surfaces 40 and 42 and rearward and forward facing web surfaces 44 and 46. The forward facing strap and web surfaces 40 and 44 are desirably flared laterally away from the web 12 and two vertically spaced projections 48 are provided in the strap 38 extending toward the web 12.

Preferably, the forward edge of the strap 38 is flared only partially across the length thereof so as to reduce the likelihood of splitting in the manufacturing process.

The sloping shoulders 36 and 41 of the groove serve as guides for the tongue of the connecting beam and the coplanar tongue and groove enhance the resistance of the tongue 18 to folding at the junction of the tongue and web. This resistance is enhanced by a further longitudinal bead 50 formed into the tongue and groove. As earlier described, the sloping shoulders of the tongue and groove are vertically spaced at the junction of the web and tongue to separate (a) the transition of the metal of the web from the plane of the web to the plane of the groove from (b) the intersection of the tongue and the web.

The tongue 18 is provided with a detent 52 laterally displaced in the same direction as the strap 38 to form a rearward facing surface. The detent 52 is aligned with the longitudinal stiffening bead 50 which is laterally displaced in the opposite direction as the strap 38 and extending from a point slightly rearward of the detent 52 to a point adjacent the rearward facing web surface 46.

Figure 4A:
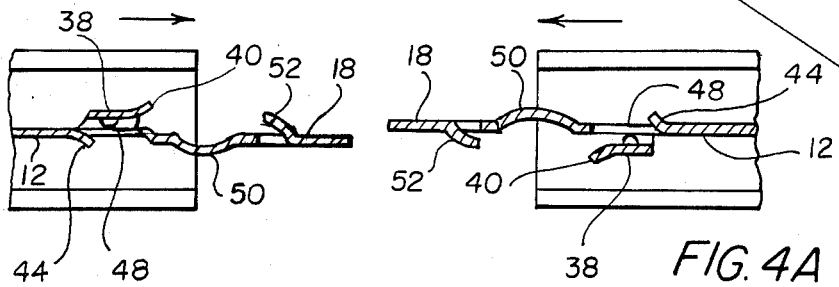
FIGS. 4A and 4B are top plan views of the main beam of FIG. 1 in section taken through lines 4—4 illustrating the connectors before and after connection respectively.
Figure 4B:
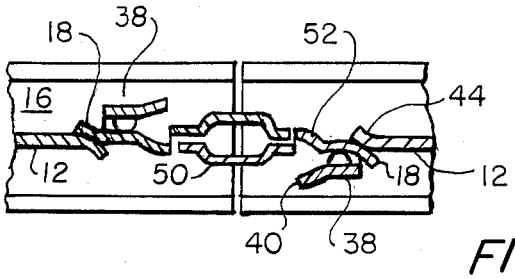

With continued reference to FIGS. 1–3, and particularly to FIGS. 4A and 4B, adjacent beams 10 of the present invention may be placed in end-to-end relation where the tongue 18 of each aligns with the space between the strap 38 and groove of the other for simultaneous insertion. During insertion, the sloping shoulders of the groove guide the tongue to the strap and insertion is insured as a result of the flair of the forward facing surface 40. Once inserted behind the strap 38, the dimples 48 on the strap 38 urge the tongue 18 laterally toward the web 12 and the flared forward facing web surface 44 acts to urge the tip of the tongue laterally back toward the strap 38 into engagement with the web surface. As shown in FIG. 3, the dimples 48 and flared forward facing web surface 44 continue to exert a frictional force upon the tongue 18 after engagement to maintain the beams 10 and 10*a* in the locked and longitudinally aligned relation shown in FIG. 4B.

Figure 5A:
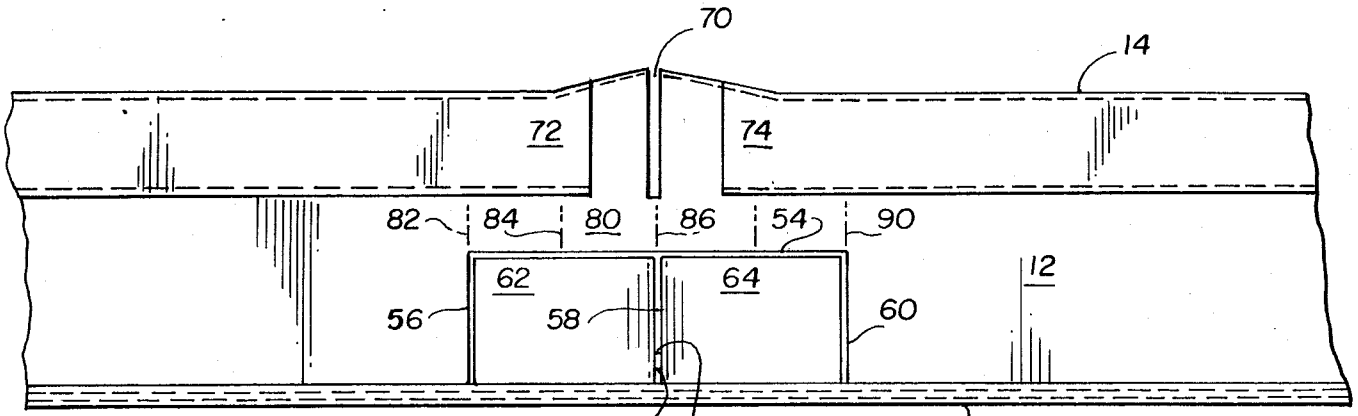
FIGS. 5A and 5B are side views in elevation of the compressible section of the main beam of the present invention before and after deformation respectively.
Figure 5B:
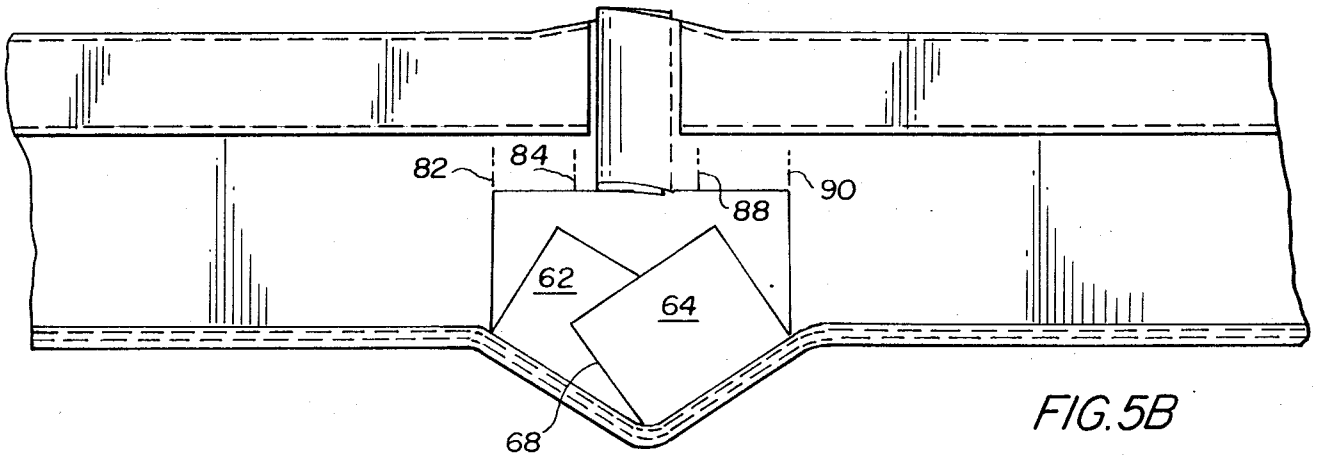

With referenence to FIGS. 5A, 5B, 6A and 6B the compressible section intermediate the ends of the beam is shown as having a flange compression section including a horizontal web slit 54 intermediate the bead 14 and flange 16 and three vertical slits 56, 58 and 60 running from the horizontal slit 54 to the flange 16 to thereby form two upstanding tabs 62 and 64. The confronting edges 66 and 68 of the two tabs 62 and 64 are flared in opposite directions to insure passage by each other as the flange 16 deforms downwardly under thermally induced longitudinal expansion of the beam 10. The deformation is localized by the vertical slits 56, 58 and 60 so that the flange 16 bends downwardly into a V-shape as shown in FIG. 5B without twisting of the beams.

Among the advantages of forming the tabs 62, 64 without removal of metal from the web 12 are enhanced lateral stability as the tabs pass by each other in sliding contact.

Figure 6A:
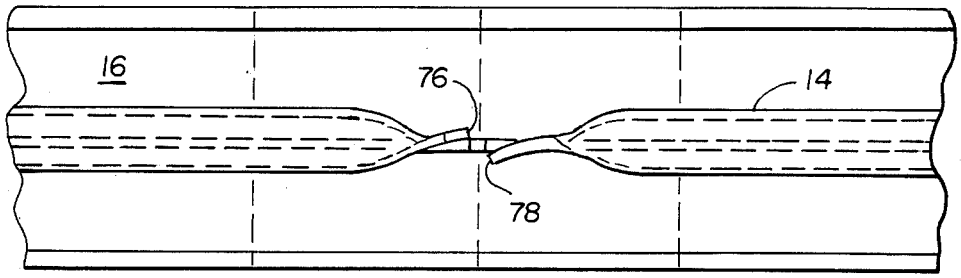
FIGS. 6A and 6B are top plan views of the compressible section of FIG. 3 before and after deformation respectively.

The compression section also includes means for controlling the compression of the bead and web. As shown in FIGS. 5A and 5B, the compression section includes a vertical slit 70 through the bead 14 in vertically alignment with the central vertical web slit 58. As shown in FIG. 6A, the bead 14 adjacent the slit on both sides 72 and 74 thereof is flattened and confronting edges 76 and 78 are laterally deformed in opposite directions in the process to insure passage by each other during thermal expansion of the beam.

As shown in FIG. 5A, the web strap 80 between the bead 14 and the tabs 62, 64 is vertically creased but not slit at five spaced locations 82, 84, 86, 88 and 90, each extending from the horizontal slit 54 upwardly toward the bead and being aligned respectively with the vertical web slit 56, 58 and 60 and the midpoints therebetween.

Figure 6B:
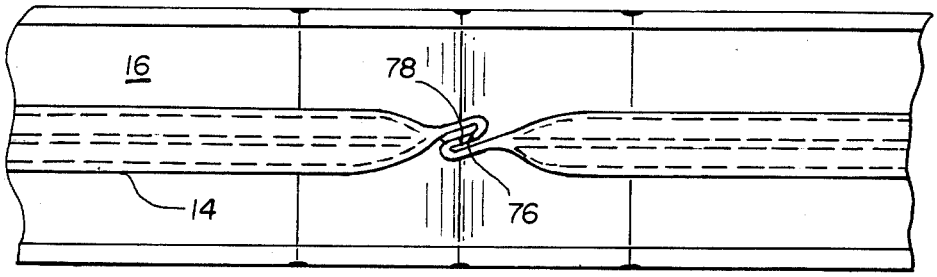

As shown in FIGS. 5B and 6B, the compression resulting from thermally induced longitudinal expansion of the beam causes the bead 14 and associated web strap 80 to roll about a vertical line aligned colinear with the bead slit 58 and web crease 88. The opposing edges of the bead flattened to reduce resistance to lateral deformation, roll past each other with clearance assured by the lateral displacement of their confronting edges 76 and 78. Since the web strap 80 has little resistance to lateral deformation, it rolls tightly with little disturbance of the longitudinal alignment of the bead 14 or the flange 16. The alternating creases 82, 84, 86, 88 and 90 assist deformation of the web strap 80.

ADVANTAGES AND SCOPE OF THE INVENTION

In one aspect of the present invention, the tongue and a portion of the web forward of the strap are unitary in construction to resist bending, i.e., are laterally offset from the web. In addition, the sloping shoulders resist bending by the bead between the detent and the strap.

The detent carried by the tongue engages the rearward facing web surface rather than the rearward facing surface of the strap, thereby shortening the tongue and reducing the risk of damage thereto.

Assembly is easily achieved as a result of the flaring of the forward facing web surface and the shoulders on the groove formed in the web.

Resistance to inadvertent separation is provided by the coaction of the tongue with the web to the rear of the strap and the two dimples on the strap.

Also, the forward facing strap surface is flared away from the web to provide a guide surface for the tongue of the connecting beam, and the vertical separation of the shoulders of the groove and the shoulder of the tongue provides clearance for the tongue into the strap.

In another aspect, the ceiling grid main beam of the present invention has a compressible section to allow controlled deformation responsive to thermally induced longitudinal expansion of the beam. The compressible section includes a flange deformation section with tabs formed by slits which require no removal of metal and thus facilitate manufacture. In addition, the tabs formed between the slits in the web continue to provide some resistance to lateral deformation and twisting during their passage by one another during and after thermal expansion.

In still another aspect, the bead modifications, and the creasing of the web strap, allow the bead and adjacent web strap to roll tightly past each other in response to thermally induced longitudinal expansion of the beam to minimize longitudinal misalignment of the bead and/or resulting twisting of the web.

These and many other advantages will be apparent from the claims and it is to be understood that the foregoing is a description of a preferred embodiment, that many modifications will occur to those skilled in the art, and that the scope of the invention is defined only by the following claims when accorded a full range of equivalents.

What is claimed is:

1. In the main beam of a fire rated ceiling panel suspension grid system including a web having a lower marginal edge with a ceiling panel supporting flange extending laterally outward therefrom on both sides; an upper marginal edge with a spaced wall, rigidity enhancing bead; longitudinal ends configured for attachment to each other; and a compressible section intermediate said ends for accommodating longitudinal thermal expansion without lateral deformation sufficient to defeat the support of ceiling panels by said flanges; the improvement wherein said compressible section comprises:

a pair of immediately adjacent tabs formed from said web integral only with the lower marginal edge thereof with confronting vertical edges laterally deformed out of the plane of said web in opposite directions to facilitate passage of said tabs by each other without substantial departure from the plane of the web when said flange buckles downwardly out of the plane thereof as a result of thermal expansion of the beam; and an interrupted bead with confronting vertical edges deformed laterally out of the plane of the web in opposite directions to facilitate the passage of the portions of said bead immediately adjacent said interruption on opposite longitudinal sides by each other as a result of the thermal expansion of the beam without substantial departure from the plane of the web, the sides of said bead being laterally compressed adjacent said interruption with the confronting vertical edges thereof vertically aligned with the confronting vertical edges of said tabs, the uninterrupted area of said web vertically intermediate said bead and said tabs forming a web strap laterally deformable under longitudinal thermal expansion of the beam without (a) causing the laterally uncompressed portion of said bead to depart from the plane thereof or (b) being severed so that the structural integrity of the beam is maintained, whereby the beam is longitudinally compressible by thermal expansion without twisting sufficiently to defeat the support of ceiling panels by said flanges.

2. The main beam of claim 1, wherein said uninterrupted area is laterally deformed at a plurality of spaced vertical segments extending from the lower edge of said web strap toward said bead, the segments being alternatingly deformed in opposite directions.

3. In a main beam of a fire rated ceiling panel suspension grid system including a web having a lower marginal edge with a ceiling panel supporting flange extending laterally outward therefrom on both sides; an upper marginal edge with a spaced wall, rigidity enhancing bead; longitudinal ends configured for attachment to each other; and a compressible section intermediate said ends for accommodating longitudinal thermal expansion without lateral deformation sufficient to defeat the support of ceiling panels by said flanges, said compressible section including an interrupted web portion for permitting said flange to buckle downwardly out of the plane thereof as a result of thermal expansion of the beam and an uninterrupted web portion to maintain the structural integrity of the beam despite longitudinal compression resulting from thermal expansion thereof, the improvement wherein said compressible section comprises means for reducing the resistance of said bead in said compressible section to lateral deformation and for predetermining the point about which said web strap deforms under the thermal expansion of the beam so that said bead retains longitudinal alignment during and after compression, said resistance means comprises an interrupted bead with confronting vertical edges deformed laterally out of the plane of said web in opposite directions, the sides of said bead being laterally compressed adjacent said interruption with the confronting edges thereof vertically aligned with the center of the interrupted web portion.

4. The main beam of claim 3, said resistance means further comprising said web strap being laterally deformed at a plurality of spaced vertical segments extending from the lower edge of said web strap toward said bead, the segments being alternatingly laterally displaced in opposite directions, one of said segments being vertically aligned with the center and each end of the interrupted web portion, and one of said segments being spaced between the center and each end of the interrupted web portion.

5. The main beam of claim 3, wherein the interruption of said bead substantially extends from the top of said bead to said web and removes no material from said bead.

6. The main beam of claim 3, wherein said interrupted web portion includes a web interrupted by a plurality of slits which remove no material from said web.

7. The main beam of claim 6 wherein said interrupted web portion includes two immediately adjacent, upwardly projecting tabs formed from said web.

8. The main beam of claim 6 wherein said interrupted web portion includes a longitudinal slit spaced approximately twothirds of the distance from said flange to said bead.

9. The main beam of claim 3 wherein said bead is compressed over a distance not less than the amount of thermal expansion of the beam.

10. A main beam of a fire rated ceiling panel suspension grid system comprising:

a web having upper and lower marginal edges;

a ceiling panel supporting flange extending laterally outward from said lower marginal edge on both sides;

a spaced wall, rigidity enhancing bead on said upper marginal edge means configured for the attachment of the ends of said web to each other; and a compressible section intermediate the ends of said web for accommodating longitudinal thermal expansion of the beam without lateral deformation sufficient to defeat the support of ceiling panels by said flanges, the web of said compressible section being interrupted adjacent said flanges to permit said flange to buckle downwardly out of the plane thereof as a result of thermal expansion of said beam, the web of said compressible section being uninterrupted adjacent said bead to form a web strap readily deformable in a lateral direction under the thermal expansion of said beam without being severed, said web strap being laterally deformed at a plurality of spaced vertical segments extending from the lower edge of said web strap toward said bead, the segments being alternatingly deformed in opposite lateral directions, the bead of said compressible section being laterally compressed and interrupted adjacent the longitudinal center thereof with confronting vertical edges deformed laterally out of the plane of the web in opposite directions so that the portions of said laterally compressed bead may pass each other during thermal expansion of the beam without substantial departure from the plane of said bead.

11. In the main beam of a fire rated ceiling panel suspension grid system including a web having a lower marginal edge with a ceiling panel supporting flange extending laterally outward therefrom on both sides, an upper marginal edge with a spaced wall rigidity enhancing bead, horizontal ends configured for attachment to each other, and a compressible section intermedite said ends for accommodating longitudinal thermal expansion without lateral deformation sufficient to defeat the support of ceiling panels by said flange, said compressible section including means for permitting said flange to buckle downwardly out of the plane thereof as a result of thermal expansion of said beam without severing said web, the improvement wherein the bead in said compressible section is fully interrupted and laterally compressed to eliminate the wall spacing adjacent said interruption on both sides thereof so as to weaken said web sufficiently to permit the longitudinal compression of said bead without destroying the alignment of the uncompressed portions thereof.

12. In a beam for a suspended panel ceiling including a web having spaced apart upper and lower marginal edges, a panel supporting flange provided along the lower marginal edge extending laterally outward from the web in both directions, a rigidity increasing bead provided along the upper marginal edge and connecting means at opposite ends configured for attachment to each other, the improvement wherein each of said connecting means comprise:

a tongue integrally joined with and extending longitudinally from said web, said tongue being laterally offset in one direction with respect to said web and having a forward portion with substantially parallel upper and lower edges and a rearward portion with edges broadening in the rearward direction to provide increased resistance to the lateral deformation of said tongue;

detent means formed in said tongue at a distance from the free end thereof, said detent means being laterally displaced from the tongue in the opposite direction to thereby form a rearward facing surface;

strap means laterally displaced from said web in said opposite direction immediately adjacent the rear end of said tongue for receiving the tongue of a like beam between said strap and said web, said strap means forming substantially vertical forward and rearward facing web surfaces and forward and rearward facing strap surfaces, said rearward facing web surface engaging the rearward facing surface of the detent means of a like beam, the rearward facing surface of said detent means engaging the rearward facing web surface of the like beam for resisting the withdrawal thereof upon the simultaneous insertion of said tongue through the strap of a like beam and the tongue of a like beam through said strap;

friction lock means for exerting a frictional force upon the tongue of a like beam connected with said beam, having:

strap cam means including two vertically spaced dimples projecting from said strap toward said web for urging the tongue of a said like beam laterally said one direction, and web cam means rearward of and adjacent to said strap for urging the end of the tongue of said like beam laterally in said opposite direction; and a stiffening bead formed in said tongue, said stiffening bead extending from a point rearwardly spaced from said detent means at the elevation thereof to a point forwardly spaced from said strap means, said stiffening bead being laterally displaced from said tongue in said one direction.

13. A beam for a suspended panel ceiling including a web having spaced apart upper and lower marginal edges, a panel supporting flange provided along the lower marginal edge extending laterally outward from the web in both directions, a rigidity increasing bead providing along the upper marginal edge and connecting means at opposite ends configured for attachment to each other, the improvement wherein said connecting means comprises:

a tongue integrally joined with and extending longitudinally from said web, said tongue being laterally offset in one direction with respect to said web;

detent means formed in said tongue, said detent means being laterally displaced from the tongue in the opposite direction to thereby form a rearward facing surface;

strap means formed from said web rearward of said tongue, said strap being laterally displaced from said web in said opposite direction to form a rearward facing web surface, a portion of said web between said rearward facing web surface and said tongue being coplanar with said tongue;

a stiffening bead formed in said web portion and said tongue between said strap and said detent means;

strap cam means laterally displaced from said strap means in said one direction for urging the tongue of connected like beam laterally in said one direction; and web cam means immediately rearward of said strap for urging the free end of the tongue of a connected like beam laterally in said opposite direction and thereby cooperate with said strap cam means to provide a friction force upon the tongue of said connected beam.

14. The beam of claim 13, wherein the depth of said tongue varies continuously over the rear portion thereof and is substantially constant over the forward portion thereof;

wherein the depth of said tongue adjacent said web is greater than at the free end thereof; and wherein the depth of the portion of said web coplanar with said tongue is greater at said tongue than at said strap means to thereby increase the resistance of said tongue to bending while permitting insertion of said forward portion thereof through said strap means.

15. The beam of claim 14, wherein the length of said rear portion of said tongue is approximately equal to the distance between said rearward facing web surface and the end of said web.

16. The beam of claim 13, wherein said stiffening bead extends from said detent means toward said rearward facing web surface at the elevation of said detent means.

17. A main beam for a suspended panel ceiling comprising:

a web having spaced apart upper and lower marginal edges;

a panel supporting flange provided along the lower marginal edge of said web extending laterally outward from the web in both directions;

a rigidity increasing bead provided along the upper marginal edge of said web;

connecting means at opposite ends of said beam configured for attachment to each other, said connecting means comprising:

a tongue integrally joined with and extending longitudinally from said web, said tongue being laterally offset in one direction with respect to said web, first detent means formed in said tongue for engaging the tongue of a like beam, said detent means being laterally displaced from the tongue in the opposite direction to thereby form a rearward facing surface, strap means formed from said web rearward of said tongue in said opposite direction to form substantially vertical forward and rearward facing web surfaces, and second detent means for exerting a frictional force upon the tongue of a like beam when inserted between said web and said strap means; and a compressible section intermediate said end for accommodating longitudinal thermal expansion without lateral deformation sufficient to defeat the support of ceiling panels by said flanges, said compressible section including:

an interrupted web portion adjacent said flange for permitting said flange to buckle downwardly out of the plane thereof as a result of thermal expansion of the beam, an uninterrupted web portion adjacent said bead to maintain the structural integrity of the beam despite longitudinal compresssion resulting from thermal expansion thereof, and means for reducing the resistance of said bead in said compressible section to lateral deformation and for predetermining the point about which said web strap deforms under thermal expansion of the beam so that said bead retains longitudinal alignment outside of said compressible section during and after compression.

18. In a beam for a suspended panel ceiling including a web having spaced apart upper and lower marginal edges, a panel supporting flange provided along the lower marginal edge extending laterally outward from the web in both directions, a rigidity increasing bead providing along the upper marginal edge and connecting means at opposite ends configured for attachment to each other, each of said connecting means comprising:

a tongue integrally joined with and extending longitudinally from said web in one direction and strap means laterally displaced from said web in the opposite direction immediately adjacent the rear end of said tongue for receiving the tongue of a like beam between said strap and said web, the improvement comprising friction lock means for exerting a frictional force upon the tongue of said like beam when connected with said beam, said friction lock means comprising:

strap cam means projecting from said strap toward said web for urging the tongue of a said like beam laterally in said one direction;

web cam means for urging the end of the tongue of said like beam laterally in said opposite direction; and a stiffening bead laterally displaced from said tongue in said one direction and extending from a point rearwardly spaced from said detent means at the elevation thereof to a point forwardly spaced from said strap means, said stiffening bead, said strap cam means, said stiffening bead, and said web cam means cooperating to provide a frictional force upon the tongue of said like beam when connected with said beam.

* * * * *